US005135322A

United States Patent [19]

Tsuru et al.

[11] Patent Number: 5,135,322

[45] Date of Patent: Aug. 4, 1992

[54] PRINTER HAVING ONE END OF PAPER BAIL SEPARATED FROM A PLATEN AND THE OTHER END THEREOF CONTACTING THE PLATEN

[75] Inventors: Yoshio Tsuru, Kani; Shunji Murai, Chiryu, both of Japan

[73] Assignee: Brother Kogyo Kabushiki Kaisha, Aichi, Japan

[21] Appl. No.: 745,283

[22] Filed: Aug. 14, 1991

[30] Foreign Application Priority Data

Sep. 18, 1990 [JP] Japan ..... 2-248139

[51] Int. Cl.[5] ..... B41J 13/20

[52] U.S. Cl. ..... 400/639.1; 400/639; 400/636

[58] Field of Search ..... 400/639, 639.1, 639.2, 400/636, 578, 579, 595, 596, 600.2, 600.3, 600.4, 601, 355, 356

[56] References Cited

U.S. PATENT DOCUMENTS

| | | | |
|---|---|---|---|
| 4,188,025 | 2/1980 | Gustafson | 400/636 |
| 4,475,825 | 10/1984 | Hashimoto | 400/636 |
| 4,514,740 | 4/1985 | Fujiwara | 400/643 |
| 4,702,632 | 10/1987 | Taketani | 400/639.1 |
| 4,918,461 | 4/1990 | Murakami | 400/642 |

FOREIGN PATENT DOCUMENTS

| | | | |
|---|---|---|---|
| 75883 | 5/1982 | Japan | 400/639.1 |
| 181885 | 11/1982 | Japan | 400/639.1 |
| 326832 | 2/1985 | Japan | 400/639.1 |
| 61-58775 | 3/1986 | Japan . | |
| 118278 | 6/1986 | Japan | 400/579 |
| 21166 | 1/1988 | Japan | 400/639.1 |

*Primary Examiner*—Edgar S. Burr
*Assistant Examiner*—J. R. Keating
*Attorney, Agent, or Firm*—Oliff & Berridge

[57] ABSTRACT

A printer comprises a rotatable platen for supporting a sheet and a printhead which is capable of moving along the platen to print data on the sheet. A paper bail shaft supports paper bail rollers rotatably so as to be faced to the platen. A printhead retreating unit makes the printhead retreat to a position opposed to one end of the platen at the time of a paper feed operation. Arms serve as a paper bail retreating unit to separate the paper bail rollers from the platen at the time of the paper feed operation by displacing one end of the paper bail shaft a greater distance from the platen than the other end where the printhead is retreated.

9 Claims, 9 Drawing Sheets

PRINTER HAVING ONE END OF PAPER BAIL SEPARATED FROM A PLATEN AND THE OTHER END THEREOF CONTACTING THE PLATEN

BACKGROUND OF THE INVENTION

1. Field of the Invention

This invention relates to a printer having one end of paper bail separated from a platen and the other end thereof contacting the platen and, more particularly, to a printer having a separating device for separating a paper bail, having one end of paper bail separated from a platen and the other end thereof contacting the platen, from the platen at the time of a paper feed operation.

2. Description of Related Art

Conventionally, printers have a printhead mounted on a carriage that moves along a guide shaft parallel to a cylindrical platen. The print paper is discharged upward through a space between the platen and the printhead from a lower side of the platen. Paper bail rollers are provided to bring the paper into close contact with the platen at the print position of the printhead. The paper bail rollers are rotatably attached to a paper bail shaft. Both ends of the paper bail shaft are fixed to the ends of arms that are capable of rotating to the same displacement around the same axis. Thus, the paper bail shaft is always moved substantially in parallel to the platen.

In printers of this type, paper bails are manually moved from a position in contact with the platen when the paper is initially being fed. The paper is wound around the platen from the back side to the upper front side through a space between the platen and the printhead. After the print paper has been wound around the platen, the paper bail shaft is returned to the original position in pressure contact with the platen with the paper therebetween.

There is also a type of printer in which the paper bails are moved by an actuator, for example, a motor. In this type of printer, cams are abutted against one or both of the arms so that the paper bails are moved between a position in contact with the platen and a position separated from the platen according to the displacement of the cams.

In both types of printer, however, the paper bail shaft remains substantially parallel to the platen during movement.

In the printers mentioned above, the printhead is positioned near the platen. Accordingly, in the printers having the characteristics described above, the paper bail shaft generally abuts the printhead and may be prevented from being sufficiently separated from the platen. If paper is fed while in this state, the paper is pressed against the platen by the printhead, on the side of the platen where the printhead is located, to pass through a space between the paper bail and the platen. However, on the other side, where the printhead is not located, and the paper is not pressed against the platen by the printhead, the paper tends to separate from the platen and the paper cannot pass through the space between the platen and the paper bail because the space is small. As a result, the paper bail shaft becomes an obstacle at that side in the manual paper feed mode, which slows the paper feed operation.

There is also a problem in the automatic paper feed mode. Again the paper is pressed against the platen by the printhead on the side where the printhead is located, and the paper passes through a space between the paper bail and the platen. On the other side of the platen, the paper does not pass through a space between the paper bail and the platen because the sheet cannot be adequately curved. This is particularly true if the hardness of print paper is high. Therefore, the tip end of paper cannot be inserted through a space between the platen and the paper bail roller on the side away from the printhead if the space between the platen and the paper bail roller is small.

OBJECTS AND SUMMARY OF THE INVENTION

It is an object of the present invention to overcome the above described drawbacks and disadvantages and to provide a printer having one end of paper bail separated from a platen and the other end thereof contacting the platen.

Another object of the present invention is to provide a printer having a paper bail which is sufficiently separated from a platen on the side away from the printhead.

Other objects of the present invention are to provide a printer having a paper feed facility without changing the size of the printhead or the like and to provide a printer capable of feeding paper of any quality in the automatic paper feed mode.

To achieve the above objects, according to the invention, the printer comprises;

a platen means for supporting a sheet;

a printing means for printing data on the sheet supported by the platen means, the printing means moving along the platen means between both ends of the platen means;

a retreating means for retreating the printing means to a retreated position opposed to one end of said platen means at the time of a paper feed operation;

a paper bail means for feeding the sheet in cooperation with the platen means; and paper bail means that moves between a position in contact with the platen means and a position separated from the platen means; and separating means for separating the paper bail means from the platen means at the time of the paper feed operation so that the separated distance between one end of the paper bail means and the platen means is larger than the separated distance between the other end of the paper bail means and the platen means corresponding to the retreating position to which the printing means has retreated.

In a printer having a structure as described above, a printing means is moved to the vicinity of one end of platen means in a paper feed operation (home position). In this state, even if a paper bail means is to be largely displaced in the vicinity of the above-mentioned end, it is prohibited from being moved in abutment against the printing means while there is a relatively large space at the other end of the platen where the printing means is not located. Consequently, in the present invention, the side of the paper bail means where the printing means is not located is displaced a greater distance than the side where the printing means is located. In the paper feed operation in this state, the paper is pressed against the platen means by the printing means on the side where the printing means is located to pass through the space between the paper bail means and the platen means. Meanwhile on the other side, although the paper is not pressed against the platen means by the printing means, the paper can easily pass through the space between the platen means and the paper bail means because the space between the platen means and the paper bail means is large.

As is obvious from the above description, the paper bail means can be largely retreated without any change in size of the printhead or other structure, thereby facilitating the paper feed operation. Consequently, operator efficiency can be remarkably enhanced in using the printer when paper is manually fed. Moreover, paper of any quality can be securely fed in such a printer when the paper is automatically fed.

BRIEF DESCRIPTION OF THE DRAWINGS

The foregoing and other objects, features and advantages of the present invention will become more apparent by reading the following detailed description of the preferred embodiments of the invention, when considered in connection with the accompanying drawings, in which.

DETAILED DESCRIPTION OF THE PREFERRED EMBODIMENTS

The present invention will be described in detail by an example of the application to a printer with an automatic paper feed function and with reference to the drawings.

Figure 2:
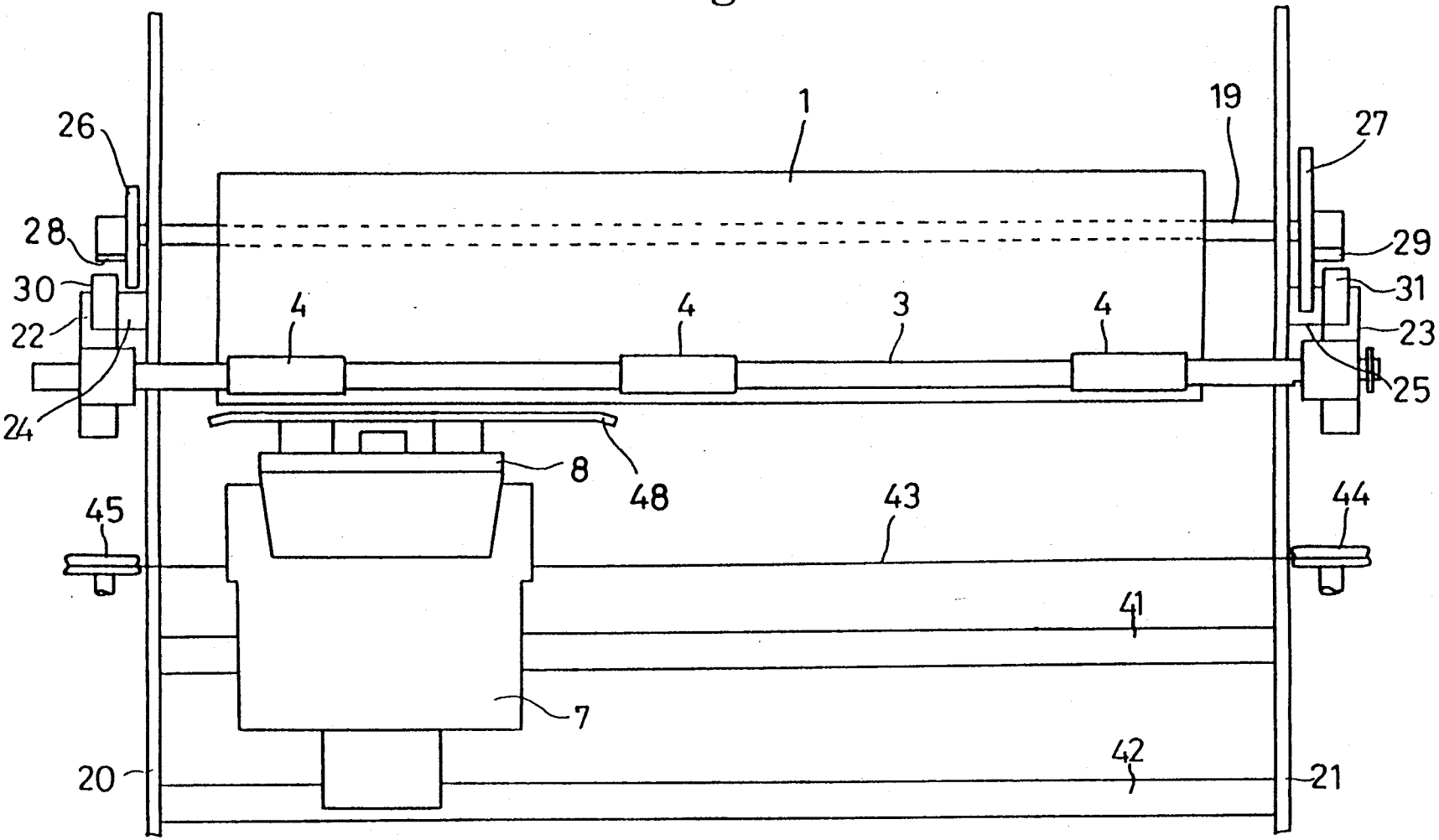
FIG. 2 is a top plan view showing a state where the paper bail rollers are pressed toward the platen.
Figure 3:
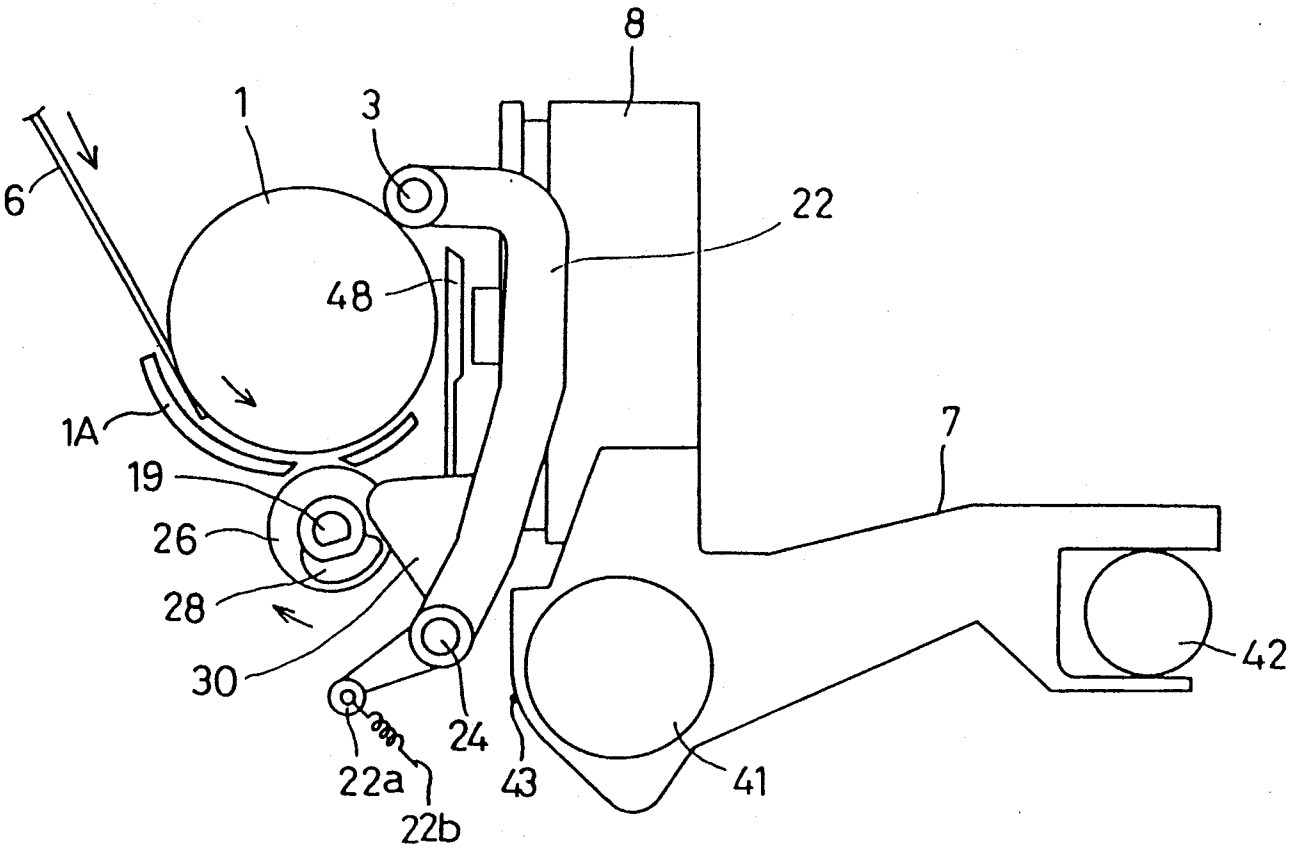
FIG. 3 is a left side view schematically showing a state where the paper bail rollers are pressed toward the platen.
Figure 7:
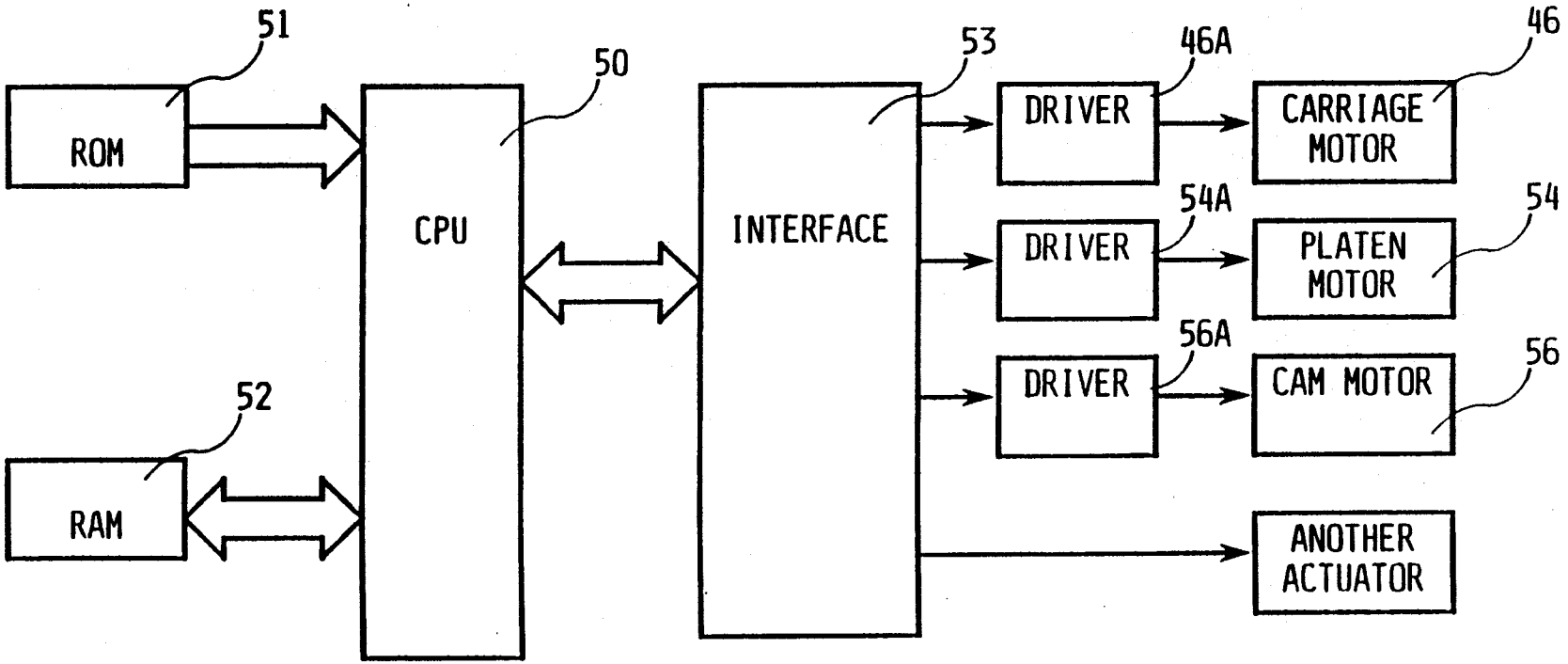
FIG. 7 is a block diagram of a control circuit.

As shown in FIG. 2, a platen 1 is mounted between plate type right and left side frames 20, 21 of the printer. In front of the platen 1, guide shafts 41, 42 are disposed in parallel to the platen 1 as shown in FIG. 3. A carriage 7 is engaged on the guide shafts 41, 42 in such a manner as to be movable in a lateral direction along platen 1. A printhead 8, which functions as a printing means, is secured to the carriage 7 in a face-to-face relationship with the platen 1. A carriage wire 43 extends from the carriage 7 to be wound around pulleys 44, 45 which are rotatably attached to the right and left side frames 21, 20. The right pulley 44 is connected to the rotary shaft of a carriage motor (stepping motor) 46, illustrated in FIG. 7, via a deceleration gear (not shown). The carriage 7, the pulleys 44,45, the wire 43 and guide shafts 41,42 function as a retreating means.

Mounted to the carriage 7 is a fixed paper meter 48 lying in substantially the same plane as that of the printhead 8 to serve as a paper guide.

As depicted in FIG. 2, both ends of a paper bail shaft 3, for rotatably supporting paper bail rollers 4, project outward from the right and left side frames 20,21 of the printer, and are disposed at the upper ends of pivotable arms 22, 23 which are bent in a predetermined shape. The arms 22, 23 are rotatably supported on support shafts 24, 25 projecting outward from the right and left side frames 20, 21 (see FIGS. 3 and 4). One end of springs 22*b*, 23*b* are attached to the lower ends 22*a*, 23*a* of the arms 22, 23 respectively and the other end of springs 22*b*, 23*b* are attached to the lower plate (not shown) so as to energize the arms 22, 23 in such a direction as to press the paper bail rollers 4 against the platen 1. A paper guide plate 1A is disposed parallel to the circumference of the platen 1 below a lower portion thereof. The paper bail shaft 3 is formed of metal which can twist as described below. The paper bail shaft 3 and the paper bail rollers 4 function as the paper bail means.

Figure 4:
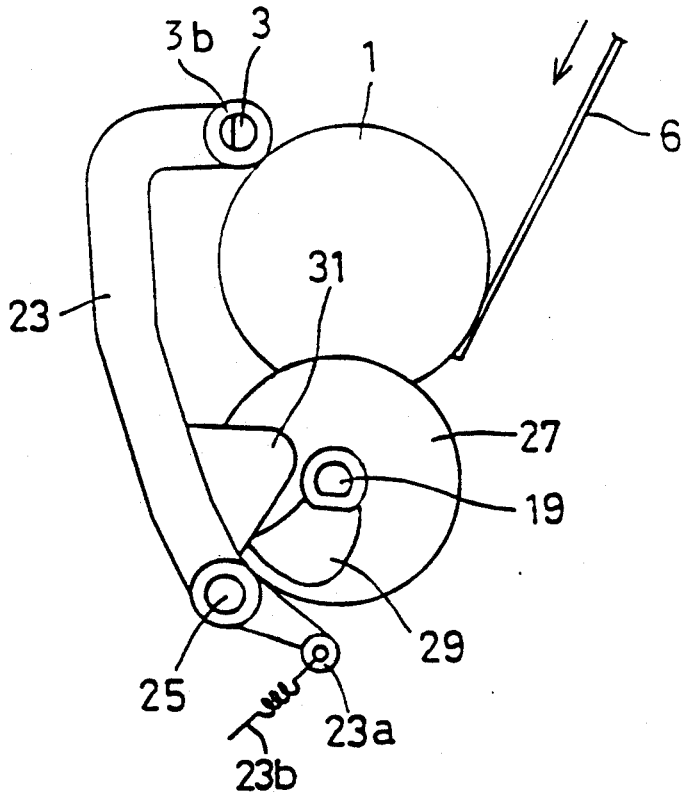
FIG. 4 is a right side view schematically showing a state where the paper bail rollers are pressed toward the platen.

Behind the arms 22, 23 are disposed cam plates 26, 27 that are fixed at both ends of a shaft 19 extending in parallel to and beneath platen 1. As shown in FIGS. 3 and 4, cam portions 28, 29 are formed at a predetermined angular position on the cam plates 26, 27. Corresponding to the cam portions 28, 29 are formed substantially triangular sideward projections 30, 31 of the arms 22, 23 respectively. The arms 22, 23, the cam portions 28, 29 and the cam plates 26, 27 function as a separating means.

In FIG. 2, the diameter of the right cam plate 27 is larger than that of the left cam plate 26, and in the same way, the right cam portion 29 is larger than the left cam portion 28. The right and left sideward projections 30, 31 have the same size. The cam plates and cam portions on the right and left sides of conventional printers have the same sizes, respectively.

The right and left cam plates 26, 27 are rotated together with the rotation of the shaft 19. When the cam portions 28, 29 are separated from the projections 30, 31, as shown in FIGS. 3 and 4, the paper bail rollers 4 are pressed against the surface of the platen 1 by the springs 22*b*, 23*b*.

Figure 6:
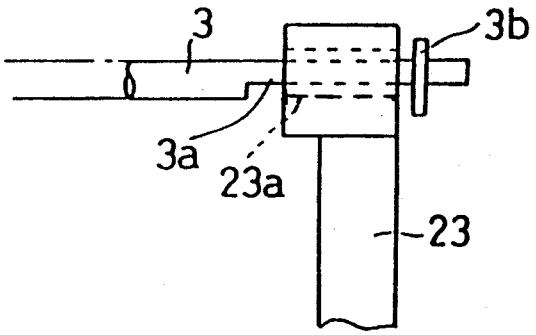
FIG. 6 is a front view showing a state where a paper bail shaft is fixed in a right arm.
Figure 5:
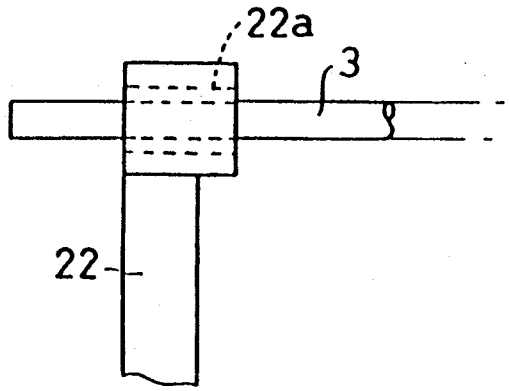
FIG. 5 is a front view showing a state where the paper bail shaft is fixed in a left arm.

Next, the connection of the arms 22, 23 with the paper bail shaft 3 will be described. The position of tip of the arm 22 for supporting the paper bail shaft 3 is different from position of tip of the arm 23 during a paper feed operation where the paper bail shaft 3 is separated from the platen 1. As for the right arm 23 (FIG. 6), the fixing hole 23*a* of the paper bail shaft 3 in the arm is formed in a "D" shape which consists of a circular portion and a linear portion. The linear portion of the "D" shape of the paper bail shaft 3 is formed in a side facing the arm 23 and the circular portion is formed in a side faced to the platen 1. The right end 3*a* of the paper bail shaft 3 is cut in a "D" shape which consists of a circular portion and a linear portion slightly smaller than that of the fixing hole 23*a* as illustrated in FIG. 6. The linear portion of the "D" shape of the paper bail shaft 3 is formed in a side faced to the arm 23 and the circular portion is formed in a side faced to the platen 1 Accordingly, the paper bail shaft 3 can be slightly twisted with respect to the arm 23, and the paper bail shaft 3 is prevented from being drawn from the arm 23. A clamp 3*b* is fixed at the right end of the paper bail shaft 3 so that the paper bail shaft 3 is not drawn from the arm 23. The arm 22, with the left end of the paper bail shaft 3 fixed thereto, is provided with a fixing hole 22*a* slightly larger than the paper bail shaft 3, as shown in FIG. 5, and the paper bail shaft 3 is slidably inserted into the fixing hole 22*a*. Consequently, the arms 22, 23 are turnable to different angles, respectively.

The control circuit for controlling the printer explained above will now be described. The control circuit, shown in FIG. 7, comprises a CPU 50, a ROM 51, a RAM 52, and an interface 53. The CPU 50 is operated on the basis of a program stored in the ROM 51 to control various motors, such as the carriage motor 46, a platen motor 54 for rotating the platen, and a cam motor 56 for rotating the cam plates 26, 27, through the interface 53. The CPU 50 can receive data from a host computer (not shown).

Figure 8:
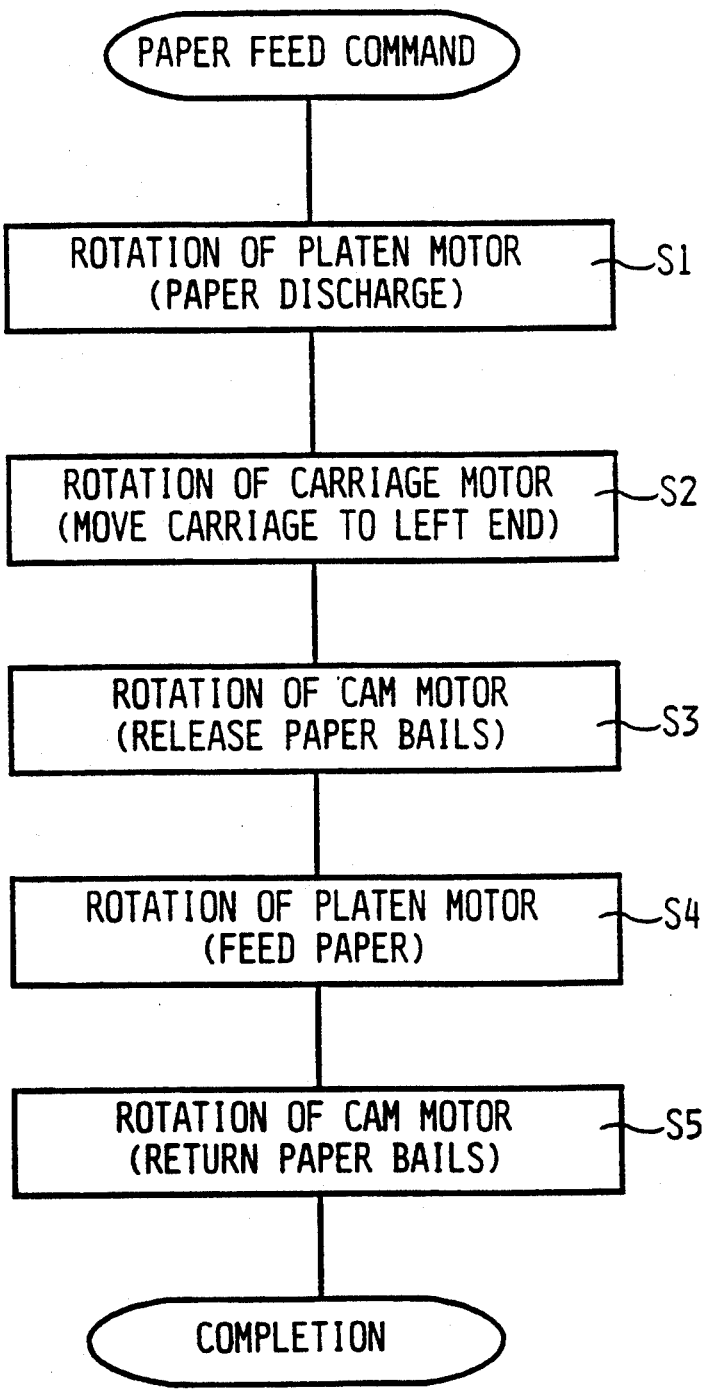
FIG. 8 is a flowchart of a paper feed operation.

The operation of the printer having the above-mentioned structure will be explained referring to the flowchart of FIG. 8. Upon turning-on of a power source, the CPU 50 rotates the carriage motor 46 for a predetermined time. The carriage 7 is moved toward the left end of platen 1 to be abutted against a stopper (not shown) that projects from the left side frame 20. The rotation of carriage motor 46 stops when the carriage 7 is abutted against the stopper. In this state, a print operation is performed in response to a command sent from the host computer.

Figure 1:
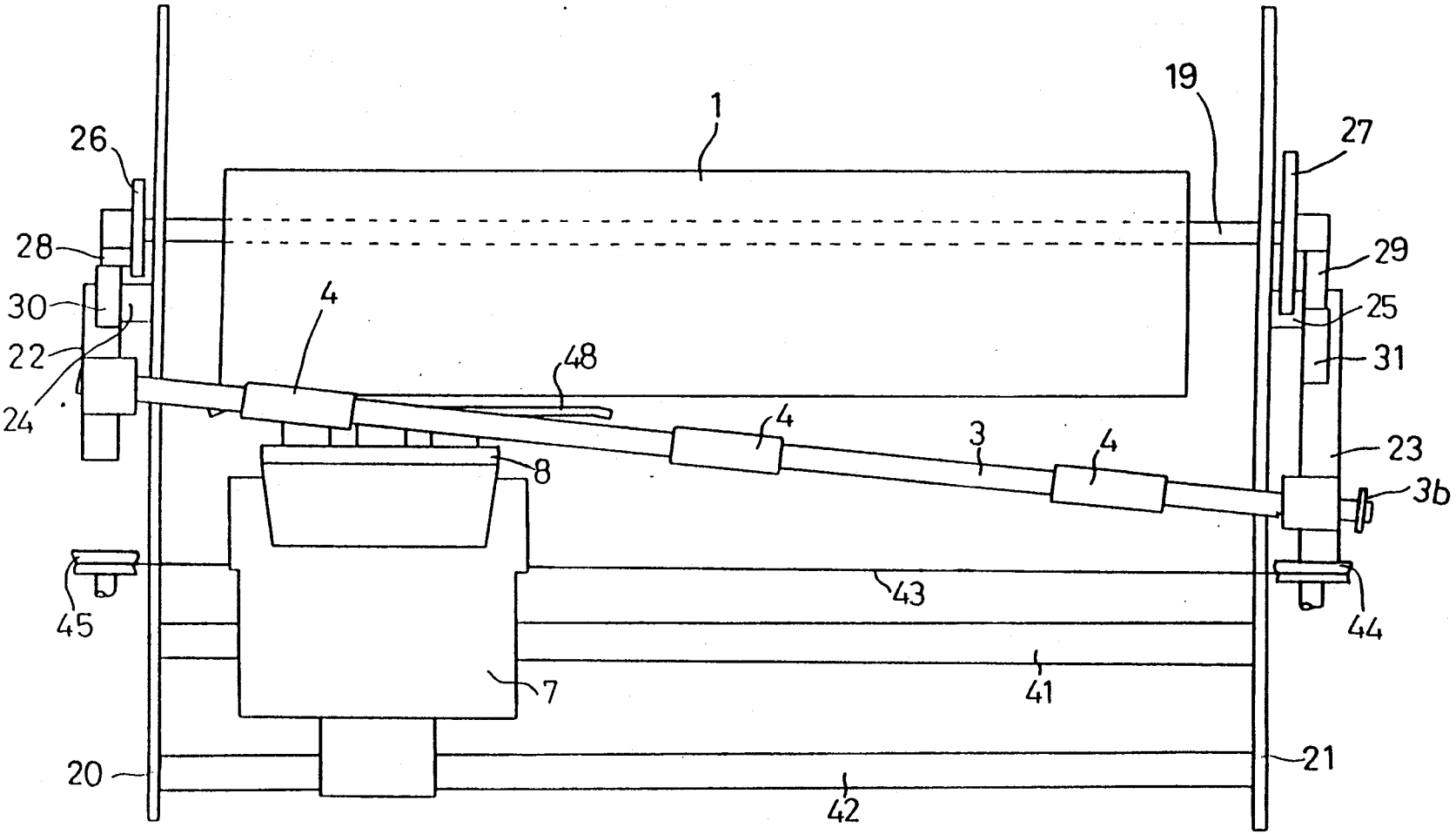
FIG. 1 is a top plan view showing a state where paper bail rollers are retreated from a platen.
Figure 9:
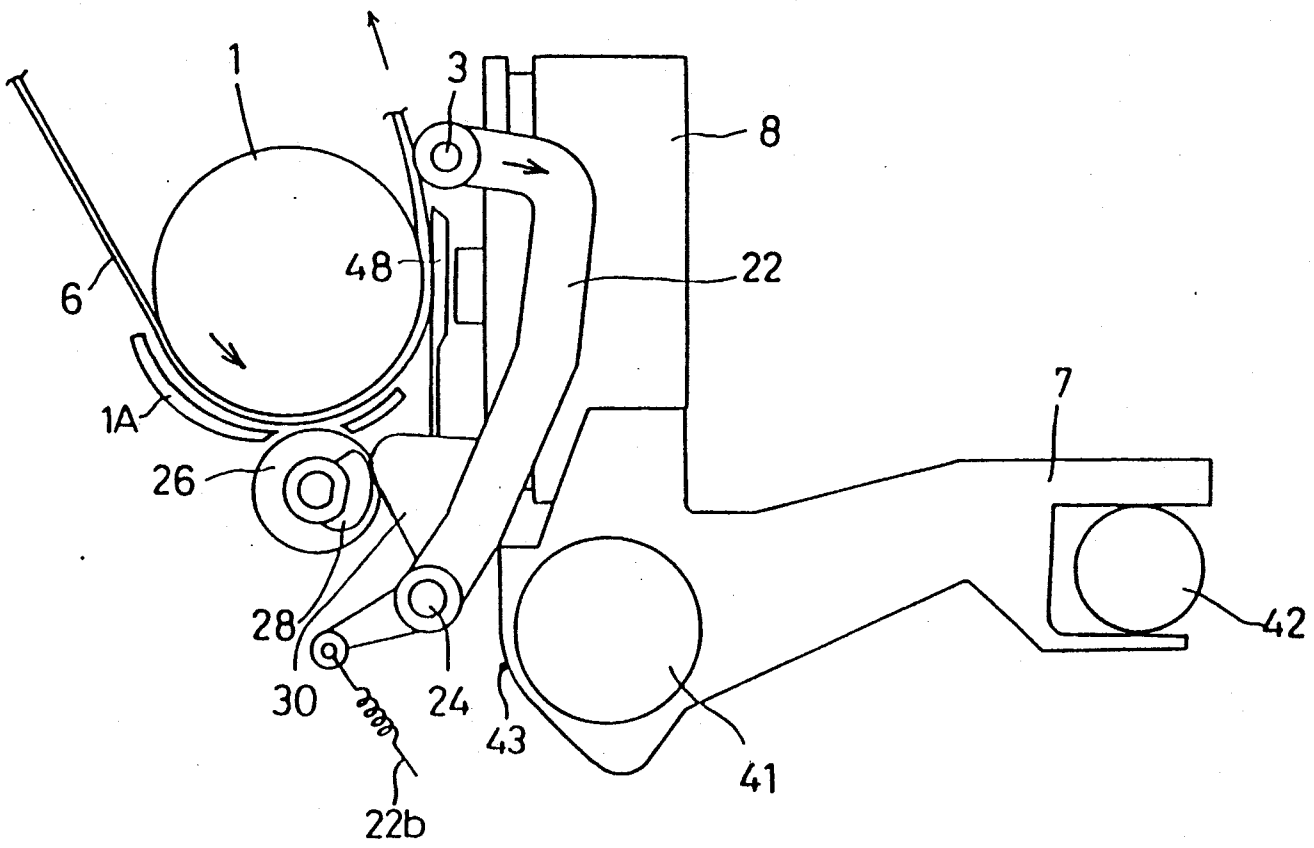
FIG. 9 is a left side view schematically showing a state where the paper bail rollers are retreated from the platen.
Figure 10:
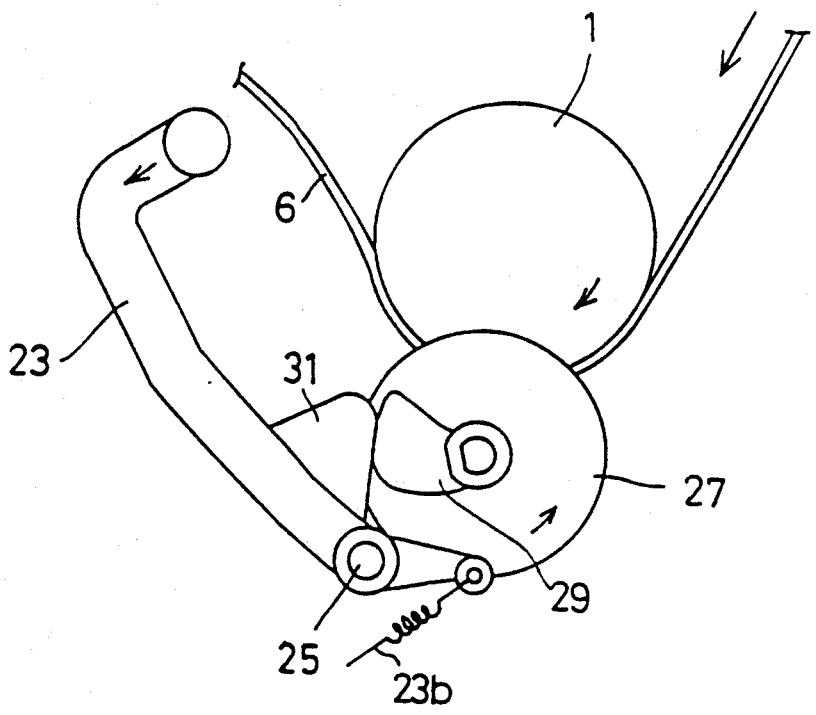
FIG. 10 is a right side view schematically showing a state where the paper bail rollers are retreated from the platen.

When a paper feed operation is instructed by using a switch (not shown) found on the printer or by a command sent from the host computer, the CPU 50 rotates the platen 1, through the interface 53, to discharge the print paper which has been already wound around the platen (S1). The carriage motor 46 is rotated so that the carriage 7 is moved toward the left end (S2) and the cam motor 55 is rotated (S3). Consequently, the cam portions 28, 29 engage the projections 30, 31 to displace the paper bail shaft 3 as depicted in FIGS. 9 and 10. As shown in FIGS. 9 and 10, since the right cam portion 29 is larger than the left cam portion 28, the rotation of the right arm 23 is greater than that of the left arm 22. Therefore, as shown in FIG. 1, the paper bail shaft 3 is released slantwise so that the distance between the right end of the paper bail shaft 3 and the platen 1 is longer than that between the left end of the paper bail shaft 3 and the platen 1.

In this state, the platen motor 54 is rotated through a predetermined angle (S4). Print paper 6 waiting behind the platen 1 (FIGS. 3 and 4) is fed by a predetermined distance so that the lead edge thereof reaches above a paper discharge port. On the side where the printhead 8 is located, the print paper 6 is guided by the paper meter 48 and is fed, while being pressed in the vicinity of the platen 1 to easily pass between the platen 1 and the paper bail shaft 3. Meanwhile, on the side where the printhead 8 is not located, the print paper 6 can easily pass between the platen and the paper bail shaft 3 because of the large distance. After that, the cam motor 56 is rotated again. The arms 22, 23 are turned by the energizing force of the springs 22*b*, 23*b*, and the paper bail rollers 4 are brought into a position with the print paper is pressed against the platen 1 by the paper bail rollers 4. In this state, the print operation can be performed again. Consequently, in the printer according to the invention, the automatic paper feed operation can be securely performed with respect to paper of any hardness. Further, should an accidental paper jam result for any reason, it can be easily corrected because of the large distance between the platen 1 and the paper bail shaft 3 on the right side.

Although the invention has been described as applied to a printer capable of automatically feeding paper, the present invention is not limited in its practical application to the foregoing specific embodiment and it is applicable also, for example, to other printers where paper is fed manually. In such a case, members such as the cams may be omitted. It is possible to stabilize the arms at such a position that the paper bails are pressed against or retreated from the platen by support springs.

While this invention has been described in connection with specific embodiments thereof, it is evident that many alternatives, modifications and variations will be apparent to those skilled in the art. Accordingly, the preferred embodiments of the invention as set forth herein are intended to be illustrative, not limiting. Various changes may be made without departing from the spirit and scope of the invention as defined in the following claims.

What is claimed is:

1. A printer comprising:

a platen means for supporting a sheet;

a printing means for printing data on the sheet supported by said platen means, said printing means moving along said platen means between both ends of said platen means;

a retreating means for retreating said printing means to a retreated position opposed to one end of said platen means at the time of a paper feed operation;

a paper ball means for feeding the sheet in cooperation with said platen means; and means for facilitating paper feeding including separating means for separating said paper ball means from said platen means at the time of the paper feed operation so that a first separating distance between one end of said paper ball means and said platen means at the end of said platen means away from said retreated position of said printing means is larger than a second separating distance between the other end of said paper ball means and said platen means adjacent to the retreated position of said printing means.

2. The printer as claimed in claim 1, wherein said paper ball means comprises a paper bail shaft and said separating means comprises a pair of arms, one arm of said pair of arms connected at each end of the paper bail shaft.

3. The printer as claimed in claim 2, wherein said separating means further comprises a cam associated with each arm of said pair of arms, each cam having a diameter different from the other cam.

4. The printer as claimed in claim 2, wherein said paper bail shaft is twisted in respect to the arm when in an open position.

5. A printer comprising:

a platen means for supporting a sheet;

a printing means for printing data on the sheet supported by said platen means, said printing means moving along said platen means between both ends of said platen means;

a retreating means for retreating said printing means to a retreated position opposed to one end of said platen means at the time of a paper feed operation;

a paper bail means for feeding the sheet in cooperation with said platen means, said paper bail means including a paper bail shaft; and separating means including a pair of arms, one arm of said pair of arms connected at each end of the paper bail shaft and a pair of cams, one cam of said pair of cams associated with each arm of said pair of arms, each said cam having a different diameter than the other cam, said separating means for separating said paper bail means from said platen means at the time of the paper feed operation so that a second separating distance between one end of said paper bail means and said platen means is larger than a first separating distance between an opposite end of said paper bail means and said platen means corresponding to the retreated position where said printing means is retreated.

6. A printer comprising:

a platen;

a print carriage, said print carriage mounting a printhead and movable along a print guide parallel to said platen;

a control means for controlling operation of the printer, one control action being to position said print carriage at a home position opposite to one end of said platen;

a paper bail comprising a paper bail shaft and paper bail rollers for holding a print medium against said platen; and separating means for separating said paper bail from said platen during a paper feed operation, a first end of said paper bail at said one end of said platen where said print carriage is at the home position being separated to a first distance and a second end of said paper bail remote from where said print carriage is at the home position being separated to a second distance from said platen wherein said second distance is greater than said first distance.

7. The printer as claimed in claim 6, wherein said separating means further comprises an arm attached at each end of said paper bail shaft, each said arm being pivotally mounted to a frame of the printer, and a cam associated with each of said arms.

8. The printer as claimed in claim 7, wherein each said arm has a protuberance extending from said arm above said pivotal mount so as to engage said associated cam, said cam associated with said arm adjacent said print carriage at said print carriage retreated position being smaller than said cam associated with said arm remote from said print carriage retreated position.

9. The printer as claimed in claim 8, wherein each of said arms has a extension extending below said pivotal mount and a spring connected between said extension and a side frame of the printer to exert a force on each of said arms so as to move said paper bail to a closed position.

* * * * *